United States Patent [19]

Willems

[11] Patent Number: 4,795,381

[45] Date of Patent: Jan. 3, 1989

[54] VESSEL AND DRIVING MEANS

[76] Inventor: Karel Willems, Oranje Nassaustraat 1a, 2271 SJ Voorburg, Netherlands

[21] Appl. No.: 89,047

[22] Filed: Aug. 24, 1987

Related U.S. Application Data

[63] Continuation of Ser. No. 767,026, Aug. 19, 1985, abandoned.

[30] Foreign Application Priority Data

Feb. 27, 1985 [NL] Netherlands ..... 8500522

[51] Int. Cl.[4] ..... B63H 16/20

[52] U.S. Cl. ..... 440/26; 440/21; 440/24; 441/74

[58] Field of Search ..... 440/21, 24, 25, 26, 440/27, 29, 30, 31, 32, 70; 441/74; 114/363

[56] References Cited

U.S. PATENT DOCUMENTS

| | | | |
|---|---|---|---|
| 637,051 | 11/1899 | Wasek | 440/29 |
| 4,474,502 | 10/1984 | Daoud | 440/29 |
| 4,496,325 | 1/1985 | Tweg | 440/26 |

FOREIGN PATENT DOCUMENTS

| | | | |
|---|---|---|---|
| 753066 | 2/1967 | Canada | 440/26 |
| 2315913 | 10/1974 | Fed. Rep. of Germany | 440/26 |
| 2418614 | 10/1975 | Fed. Rep. of Germany | 440/26 |
| 2512928 | 8/1976 | Fed. Rep. of Germany | 441/74 |
| 3407778 | 11/1984 | Fed. Rep. of Germany | 440/30 |
| 3329357 | 2/1985 | Fed. Rep. of Germany | 440/27 |
| 3403706 | 8/1985 | Fed. Rep. of Germany | 441/74 |
| 761581 | 3/1934 | France | 440/32 |
| 484725 | 9/1953 | Italy | 440/26 |
| 48104 | 4/1981 | Japan | 440/26 |
| 329038 | 5/1930 | United Kingdom | 440/32 |

*Primary Examiner*—Sherman D. Basinger
*Assistant Examiner*—Paul E. Salmon
*Attorney, Agent, or Firm*—John P. Snyder

[57] ABSTRACT

The invention relates to a vessel which comprises a floating body upon which a seat for a person is mounted. The vessel is driven by human power through a treadle mechanism which drives a propeller.

The treadle mechanism comprises two actuating elements which are each pivotable and are driveable by arms or legs and which are coupled by a driving shaft through a freewheel clutch. By avoiding the death centers which are present in a cycle treadle mechanism, human power is used efficiently.

By making the floating body a gliding body the water resistance is reduced, so that together with the efficient propulsion mechanism a high travelling speed through the water is reachable.

3 Claims, 3 Drawing Sheets

Figures 1, 2, 3, 4, 5, 5A, 5B, 5C, 5D, 5E, 5F, 5G, 5H:
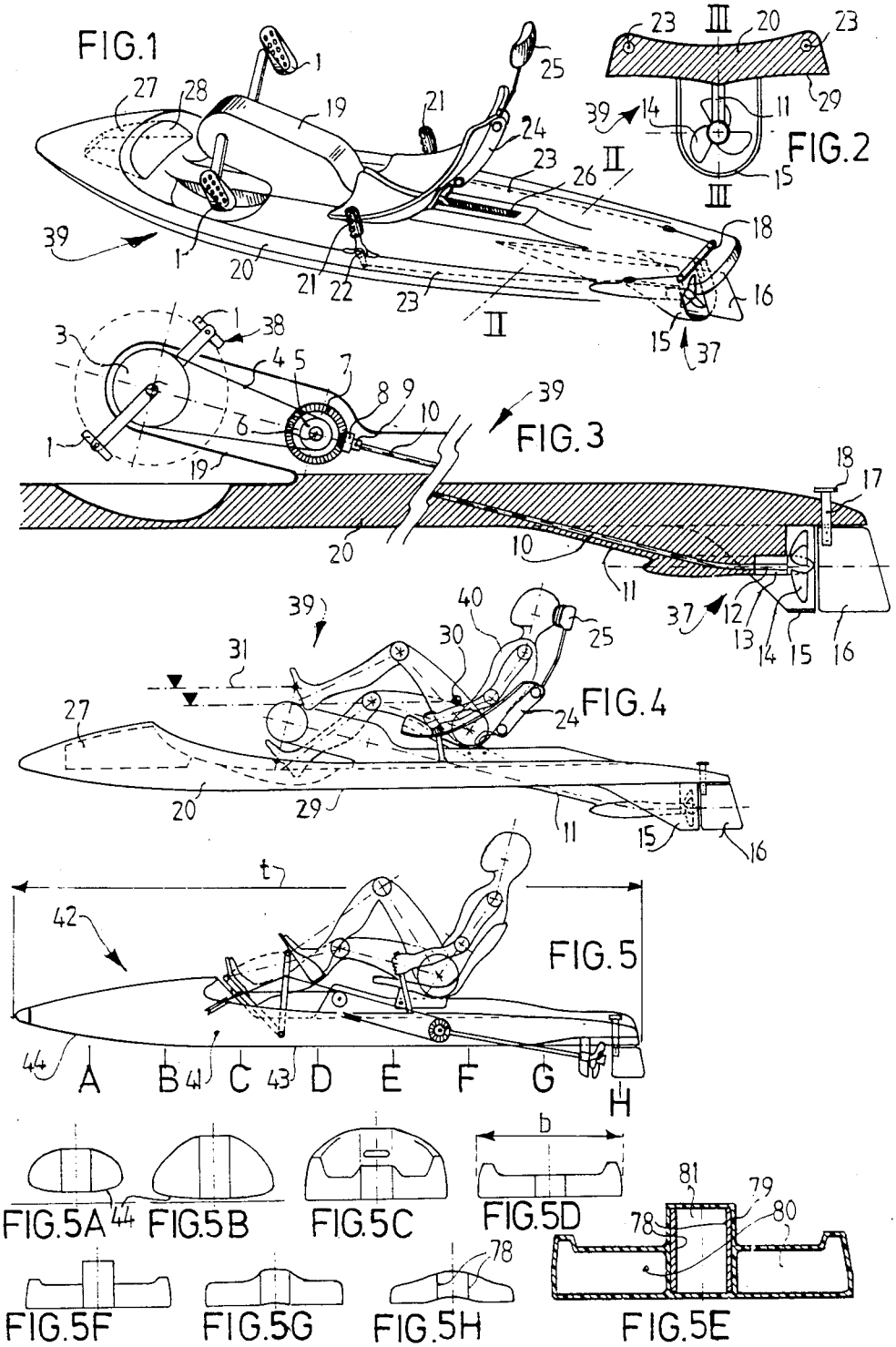

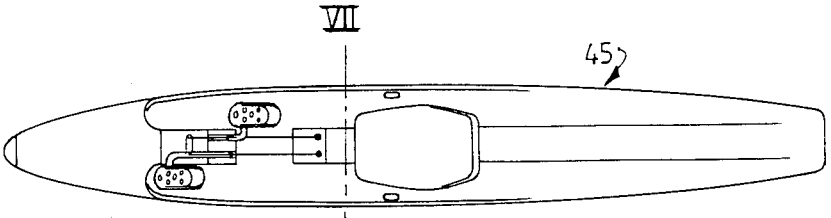
FIG.6
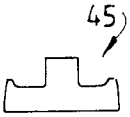
FIG.7
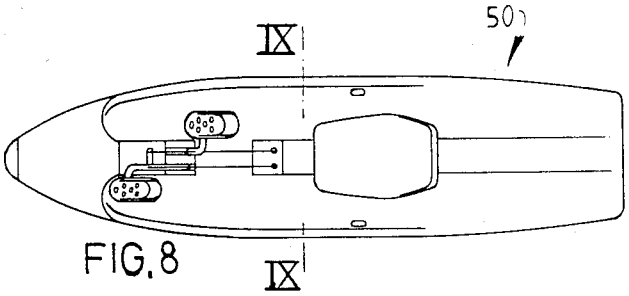
FIG.8
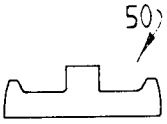
FIG.9
FIG.10
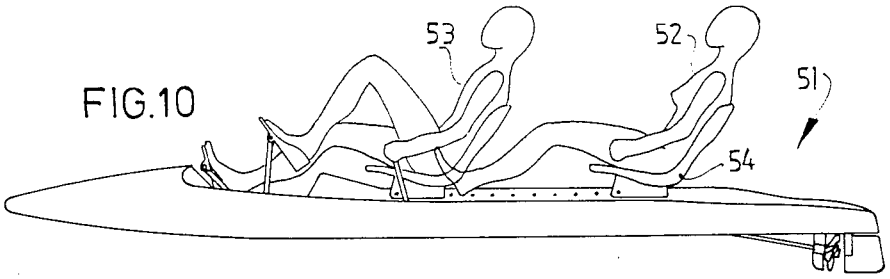
FIG.11
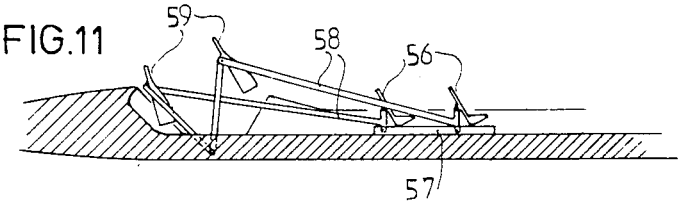

FIG.12
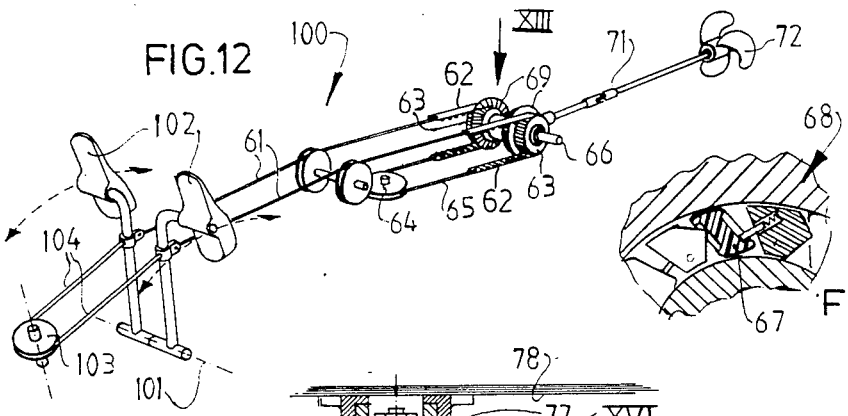
FIG.16
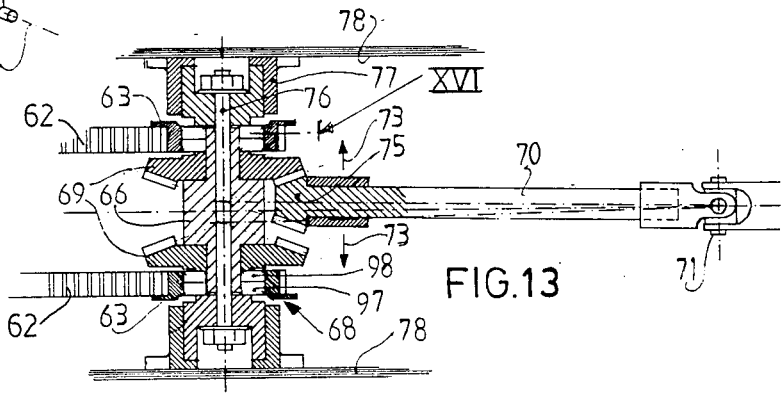
FIG.13
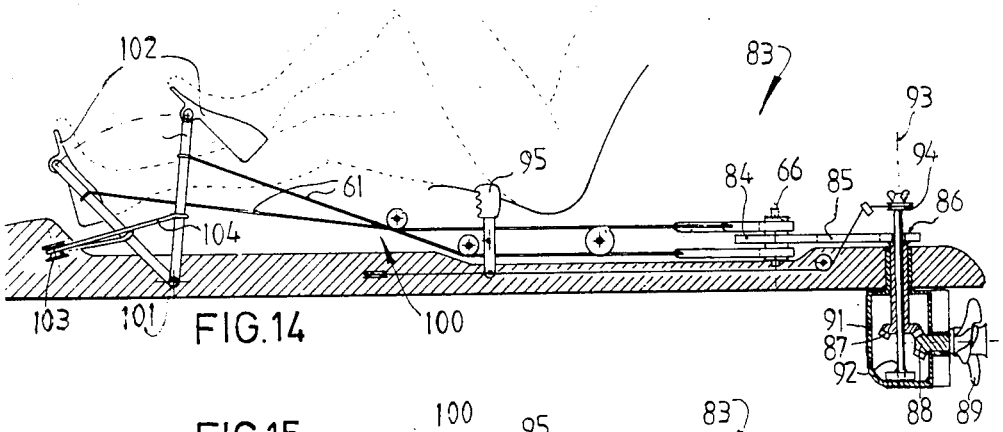
FIG.14
FIG.15
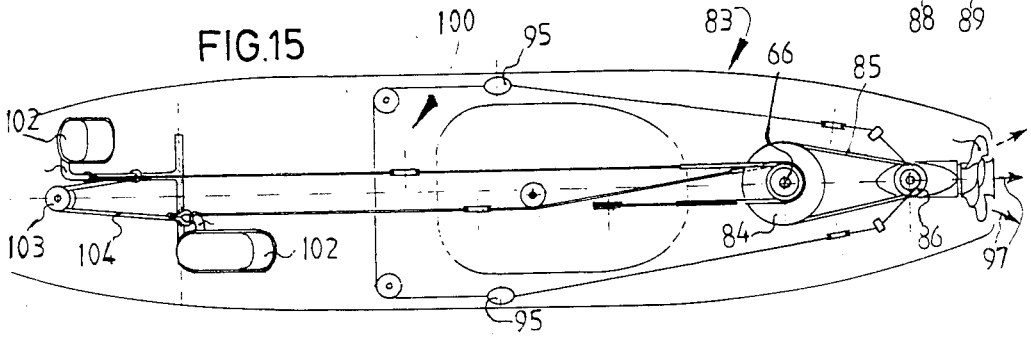

VESSEL AND DRIVING MEANS

REFERENCE TO RELATED APPLICATION

This application is a continuation of copending application Ser. No. 767,026, filed Aug. 19, 1985, now abandoned.

The invention concerns a vessel, at least comprising a floating body, a seat carried by the floating body for a person, a treadle mechanism driveable by the person through his arms and/or his legs, and propulsion means coupled to the treadle mechanism.

Such an invention is known from FR-A No. 926747. In the known vessel the floating consists of a boat upon which the seat and the treadle mechanism are positioned. All this being such, that travelling can only take place with low speed.

The inventions aims to provide a vessel which is driveable by human power to a considerable speed. To that end the floating body of the vessel according to the invention is a gliding body.

The invention concerns and provides as well driving means, in which human power is used efficiently. For that purpose two actuating elements each being pivotable to and fro are provided which are driveable by arms or legs and which are each coupled to a driving shaft through a freewheel clutch. The power reducing phenomenon of death centres as being present in a cycle treadle mechanism is not present. By application of these driving means in a vessel according to the invention extremely high travelling speed is reachable.

The mentioned and other characteristics of the invention will be illucidated in the following description by means of a drawing.

In the drawing schematically show:

FIGS. 1 and 4 a perspective and an elevated view respectively of a vessel according to the invention, FIG. 2 a cross section over the line II—II of FIG. 1, FIG. 3 a cross section over the line III—III of FIG. 2, FIG. 5 a side view of another vessel according to the invention, FIGS. 5A to 5H schematic cross sections over the lines A–H of FIG. 5, in which in FIG. 5E some more material is sketched.

FIGS. 6 and 8 each a top view of another vessel according to the invention, FIGS. 7 and 9 a cross section over the line VII—VII and IX—IX of FIGS. 6 and 8 respectively, FIG. 10 a side view of another vessel according to the invention, FIG. 11 a longitudinal section through a part of another vessel according to the invention, FIG. 12 a perspective view of a treadle mechanism for a vessel according to the invention, FIG. 13 on enlarged scale a horizontal through section over the part XIII of FIG. 12, FIGS. 14 and 15 a cross section and a top view respectively of a vessel with another treadle mechanism according to the invention, and FIG. 16 on enlarged scale a part of a longitudinal section over the line XVI of FIG. 13.

The vessel 39 of FIGS. 1 to 3 comprises a floating body 20 implemented as a gliding body, a seat 24 carried by the floating body 20, a treadle mechanism 38 built inside the floating body 20 and propulsion means 37 coupled to the treadle mechanism 38.

The treadle mechanism 38 is like that of a bicycle. Two pedals 1 are moved by the feet to make a shaft 2 revolve in a circle shaped movement. The geared wheel 3 has been attached to this shaft 2. The geared wheel 3 drives a smaller geared wheel 5 through a chain 4, the geared wheel 5 being connected to a shaft 6. A conical geared wheel 7 has been attached to the shaft 6, the geared wheel 7 driving a smaller conical geared wheel 8, being positioned perpendicular thereto. A clamping sleeve 9 is mounted to the conical geared wheel 8, which sleeve forms a connection with the flexible shaft 10. The flexible shaft 10 forms a connection with a propeller shaft 12 of the propulsion means 37. The propeller shaft 12 is supported in a propeller shaft housing 13 which has been built into a propeller nacelle. A propeller 14 which is protected by a propeller cap 15 is mounted on the propeller shaft 12. Directly behind the propeller 14 a rudder 16 is hung to a vertical rudder shaft 17 which is actuated by a rudder shaft arm 18. The treadle mechanism 38 as described and the driving elements are mounted watertight in a chain housing 19, the floating body 20 and the propeller nacelle 11.

The rudder shaft arm 18 is connected to two handles 21 through steering cables 23, which handles are positioned on both sides of the seat 24 which is implemented as sit-lie element. These handles 21 are moveable forward and backward around a horizontal shaft 22 by which control of the vessel 39 is possible.

The seat 24 which is positioned directly behind the chain housing 19 comprises a head rest 25. The seat 24 is mounted in and guided in a recess 26 by which it is possible to vary the distance of the seat 24 relative to the treadle shaft 6. The head rest 25 is adjustable both in height as in forward and backward direction.

In the front part of the floating body 20 a storage space 27 is present, which can be sealed watertight by means of a lid 28.

The vessel 39 has double concave underplane 29 over its whole length. The geometry, that is to say the position of the treadle mechanism driven by human power and of the relative seat position is such that the centre of gravity 30 of the user is under the highest position 31 of the pedals 1, when the biggest torque can be applied to the driving mechanism. This geometry allows that all available muscle power can be used. The user pushes himself fixed in the seat 24 which is implemented as a sit-lie element.

With human power a considerable travelling speed of the order of 20 kms/h can be reached. To that end the underplane 29 of the floating body 20 is ski-shaped in longitudinal direction. The majority preferably is straight and for choice horizontal in longitudinal direction.

The preferred embodiment of the floating body 41 of the vessel 42 of FIG. 5 therefore has a bottom plane 43 which is flat in transverse direction for at least 50 percent, preferably the majority part for at least 80 percent and for choice 90 percent and for choice also a longitudinal direction for the majority pat which is visible from the course of the cross sections in the FIGS. 5 and 5A to 5H. Only the bow has ski-like a curved underplane 44 inclined in the forward direction. In the transverse direction this underplane 44 is slightly inclined upwards in the outward direction.

The length t is between 2 and 4 ms and is preferably 3 ms with a width b between 50 and 80 cms, for example, of about 75 cms. The form and the dimensions of the underplane 43 are choosen such that the vessel 42 glides over the water surface.

According to the invention a floating body 20 is applied which is a gliding body, that is to say that it has a principally flat underplane with a small diversion from the horizontal plane. The transverse inclination has to be less than 3° over the majority of the underplane 29, 43 and is—said again—preferably flat.

When using a vessel 45 of FIG. 6 with a bigger ratio of length to width a bigger speed than 20 kms/h is reachable, be it at the expense of some decrease of stability when the width decreases.

With a vessel 50 of FIG. 8 of which the ratio of length to width is considerably less and the length is decreasing it will be easier to reach the body speed, which is to say that the vessel 50 then develops from the displacing to the planing state. In this form the stability is optimal as well.

It is imaginable to build a seat 24 with a treadle mechanism 38 in the relative position shown in FIG. 4 upon a surf board which serves as floating body. Such a construction is in case of a bow shaped underplane of such a surf board clearly inferior to the vessels 39, 42, 45 and 50, regarding to reachable speed and stability.

The vessel according to the invention can be constructed as a vessel 51 for two persons, in which a passenger 52 can be seated in an extra seat 54 behind a pedaling person 53 (FIG. 10).

According to FIG. 11 the back person can help pedalling in a tandem embodiment by a pair of pedals which are slideable along longitudinal rails 57 through driving rods 58 which are coupled to pedals 59 which are pivotable about a shaft 60.

FIG. 12 shows a driving mechanism 100, comprising two pedals 102 with are pivotable about an axis 101, which pedals are connected to each other by means of an elastic string which is guided over a pulley 103 and which are each connected to a geared belt through a cable 61 which belts are each led over a geared wheel 63 and which are connected to each other by means of a cable 65 led over a pulley 64. Each geared wheel 63 is supported on a driving shaft 66 by means a freewheel clutch 68 which is known per se comprising a ring 98 of bearing balls and a ring 97 of coupling elements 67 (FIG. 16) which drive in one direction and which freewheel in the other direction of turning. By having both freewheel clutches 68 coupled in the same direction with shaft 66 the shaft 66 will be driven further in the same direction at each driving pedal movement per pedal. The shaft 66 is connected to two conical geared wheels 69. A driven shaft 70 drives a propeller 72 of a vessel 42 through a universal joint 71. The driven axis 70 is pivotable according to arrows 73 relative to the universal joint 71 by means of not depicted actuating means between two positions in which one of both geared wheels 69 engages a conical geared wheel 75 which is mounted on the driven shaft 70 such as to allow forward and backward travelling. The shaft 66 is supported on a pivot 76 which is mounted in fixed bearings 77 which are attached to partitions 78 of the vessel 42 of FIG. 5.

FIG. 5E shows in sectional view the partitions 78 and the way of enveloping by plastic 79 according to a rotation mould method so that hollow drive housings 80 and a centre drive housing 81 develop in which driving elements can be built.

FIGS. 14 and 15 show a vessel 83 which comprises a driving mechanism 100 which is described according FIGS. 12 and 13, by which the driving shaft 66 is coupled to a geared wheel 84 of a gear string drive 85 of which a geared wheel 86 is coupled to a propeller 89 through conical geared wheels 87, 88. The housing 91 of the geared wheels 87, 88 is pivotable about an axis 93 in the floating body 91 by mean of a standing shaft 92 being in the axis 93, comprising a steering plate 94 which is adjustable from handles 95 through a running cable to adjust the working apparatus 97 of the propeller 89 to control this vessel 83.

Preferably the elements of the driving mechanism 100 and the coupling elements are made of plastic.

What I claim is:

1. A high speed watercycling sport device comprising the combination of an elongate and shallow draft body of generally surf board form having a bottom surface, a top surface, a bow and a stern, the bottom surface being generally flat so as to facilitate planing of the body at high speeds, operator supporting means comprising a seat portion disposed adjacent said top surface and a back rest portion inclined upwardly and toward said stern so that an operator of the device is supported in a reclining position to provide a low center of gravity of the operator and inherent stability, driving means for propelling the boat including fore-and-aft movable foot pedals mounted forwardly of the operator supporting means and engageable by the feet of an operator supported in said operator supporting means, said driving means including a screw propeller means located beneath the bottom surface of the device at the stern thereof with the propeller completely submerged in water when an operator is propelling the device, means drivingly connecting said pedals with said propeller, steering means including a member adjacent said propeller means and mounted for turning movement relative to said body, and steering control means connected with said member and including manually operated control members supported by said body at opposite sides of said operator supporting means for fore-and-aft movement and engageable by the hands of an operator supported in said operator supporting means whereby the driving movement of an operator's legs and feet and the steering movement of an operator's arms and hands affords maximum efficiency and the device may be effectively operated at high speeds.

2. A device as defined in claim 1 wherein each of said pedals is connected to an actuating element supported for pivotal movement by said body in a fore-and-aft direction, said means drivingly connecting said pedals with said propeller including a driving shaft and a connecting means between each actuating element and the driving shaft, each connecting means including a freewheel clutch, and each connecting means also including a geared belt and a geared wheel.

3. A device as defined in claim 2 wherein the connecting means also comprises two oppositely directed conical gear wheels connected to said driving shaft, and a driven shaft having a third conical gear wheel connected thereto and movable into engagement with either one of the two conical gear wheels to be driven thereby.

* * * * *